US007108598B1

(12) United States Patent
Galloway

(10) Patent No.: US 7,108,598 B1
(45) Date of Patent: Sep. 19, 2006

(54) PDC INTERFACE INCORPORATING A CLOSED NETWORK OF FEATURES

(75) Inventor: Robert Keith Galloway, Highland, UT (US)

(73) Assignee: U.S. Synthetic Corporation, Orem, UT (US)

( * ) Notice: Subject to any disclaimer, the term of this patent is extended or adjusted under 35 U.S.C. 154(b) by 0 days.

(21) Appl. No.: 10/191,884

(22) Filed: Jul. 8, 2002

Related U.S. Application Data

(60) Provisional application No. 60/304,058, filed on Jul. 9, 2001.

(51) Int. Cl.
*B23F 21/03* (2006.01)
*B24D 11/00* (2006.01)

(52) U.S. Cl. ..... 451/542; 51/295; 51/309; 76/108.2; 76/DIG. 11; 76/DIG. 12; 175/428

(58) Field of Classification Search ..... 451/178, 451/542, 546; 51/293, 295, 309, 297; 76/108.2, 76/DIG. 11, DIG. 12; 175/428, 432, 426
See application file for complete search history.

(56) References Cited

U.S. PATENT DOCUMENTS 3,745,623 A 7/1973 Wentorf, Jr. et al. ..... 29/95 B
4,527,998 A 7/1985 Knemeyer ..... 51/309
4,539,018 A 9/1985 Whanger et al. ..... 51/295
4,772,294 A 9/1988 Schroeder ..... 51/309
4,941,891 A 7/1990 Tank et al. ..... 51/293
5,355,750 A * 10/1994 Scott et al. ..... 76/108.2
5,370,717 A 12/1994 Lloyd et al. ..... 51/293
5,384,470 A 1/1995 Tachibana et al. ..... 257/77
5,469,927 A 11/1995 Griffin ..... 175/432
5,560,754 A 10/1996 Johnson et al. ..... 51/297
5,711,702 A 1/1998 Devlin ..... 451/541
5,848,348 A 12/1998 Dennis ..... 419/5
5,871,060 A 2/1999 Jensen et al. ..... 175/420.2
5,890,552 A 4/1999 Scott et al. ..... 175/426
5,967,249 A * 10/1999 Butcher ..... 175/428
6,011,248 A 1/2000 Dennis ..... 219/700
6,063,333 A 5/2000 Dennis ..... 419/6
6,068,071 A 5/2000 Jurewicz ..... 175/432
6,189,634 B1 2/2001 Bertagnolli et al. ..... 175/432
6,439,327 B1 * 8/2002 Griffin et al. ..... 175/434
6,592,985 B1 * 7/2003 Griffin et al. ..... 428/332

* cited by examiner

*Primary Examiner*—Eileen P. Morgan
(74) *Attorney, Agent, or Firm*—Holland & Hart

(57) ABSTRACT

A superhard compact having an improved superabrasive-substrate interface region design for use in drilling bits, cutting tools and wire dies and the like. This compact is designed to provide an interface design to manipulate residual stresses to enhance the working the strength of the compact. The compact is provided with a network on interface features that share common walls to form cavities.

21 Claims, 8 Drawing Sheets

PDC INTERFACE INCORPORATING A CLOSED NETWORK OF FEATURES

CROSS REFERENCE TO RELATED APPLICATIONS

This application is based upon and claims priority to U.S. Provisional Patent Application No. 60/304,058 filed on Jul. 9, 2001.

BACKGROUND OF INVENTION

1. Field of the Invention

This invention relates to polycrystalline diamond compacts (PDC) used primarily in the oil and gas industry for drilling. More specifically, this invention relates to polycrystalline diamond cutters that utilize a substrate interface design that comprises a network of closed features that extend from the face of the substrate into the superabrasive layer.

2. Description of Related Art

Polycrystalline diamond compacts (PDC) often form the cutting structure of down hole tools, including drill bits (fixed cutter, roller cone and percussion bits), reamers and stabilizers in the oil and gas industry. A variety of PDC devices, specifically substrate interface designs have been described and are well known in the art. Generally, these devices do not have interface designs that include a network of closed shaped features that share common walls.

A polycrystalline diamond compact (PDC) can be manufactured by a number of methods that are well known in the art. The typical process consists of essentially placing a substrate adjacent to a layer of diamond crystals in a refractory metal can. A back can is then positioned over the substrate and is sealed to form a can assembly. The can assembly is then placed into a cell made of an extrudible material such as pyrophyllite or talc. The cell is then subjected to conditions necessary for diamond-to-diamond bonding or sintering in a high pressure/high temperature press. This detail is provided to familiarize the reader with the PDC sintering technology. For more information regarding the manufacture of PDC cutters the reader is referred to U.S. Pat. No. 3,745,623, which is hereby incorporated by reference in its entirety for the material contained therein.

There are a variety of U.S. patent documents that are helpful in providing a reader with general background information regarding PDC cutter design and manufacture. The reader is referred to the following U.S. patent documents, each of which is hereby incorporated by reference in its entirety for the material contained therein: U.S. Pat. Nos. 4,527,998, 4,539,018, 4,772,294, 4,941,891, 5,370,717, 5,384,470, 5,469,927, 5,560,754, 5,711,702, 5,871,060, 5,848,348, 5,890,552, 6,011,248, 6,063,333, 6,068,071, and 6,189,634.

SUMMARY OF INVENTION

Polycrystalline diamond compacts (PDC) are frequently used as the cutting structure on drill bits used to bore through geological formations. It is not unusual for PDC cutters to be subjected to loads down hole that exceed the working mechanical strength of the PDC (also referred to herein as the "insert") and failures can occur. A most common type of failure is delamination and spallation of the diamond table. This type of failure is typically due to excessive stress loading caused by tool vibration and/or drilling inter-bedded hard formations. Residual stresses in the PDC can also drastically reduce the working load of a PDC, which in turn limits the magnitude of loads that can be applied before failure. Typically, the most harmful residual stresses are located on the outer diameter of the cutter just above the interface to the diamond table. These particular stresses encourage cracks to propagate parallel to the interface and are believed to be the source of most delamination failures. It is desirable to minimize all harmful residual tensile stresses and to maximize the compressive stresses in the diamond table.

The geometry of the substrate or interface design can significantly affect the performance of a PDC insert. Through different interface shapes and sizes the residual stresses of a PDC can be controlled. Residual stresses are inherently part of nearly all PDC products and tend to increase with increasing diamond thickness. These stresses arise from the difference in thermal expansion between the diamond layer and the substrate after sintering at extremely high pressures and temperatures. These stresses can be detrimental to the cutter, leading to delamination of the diamond and premature failure. This inherent property of PDC can be beneficial if the stresses are managed properly. Through interface design, residual compressive stresses can be created in the diamond table to increase toughness and diamond attachment strength. With an ever-increasing trend toward thick diamond PDC, it is now more critical than ever to design substrate interfaces that manage residual stresses to minimize premature failure tendencies.

This invention, in its present embodiment, significantly reduces residual tensile stresses on the outer diameter of the cutter, thereby significantly reducing tensile stresses on the outer diameter of the cutter, and therefore, significantly reducing the tendency to delaminate. The present embodiments of the invention have a tungsten carbide substrate that includes multiple closed features that define cavities and protrude into the diamond table. The closed features of one present embodiment illustrated herein share common walls and resemble a honeycomb geometry. This illustrated embodiment having interconnected closed features in its interface works to manipulate the residual stresses to provide the diamond table with reinforcing compressive stresses, while minimizing harmful outer diameter tensile stresses. This invention has many potential embodiments. Each of these embodiments may incorporate one or more of the following objects, however, because of the envisioned many possible embodiments, it is not anticipated that all embodiments will incorporate all of the following objects. Therefore, the limitations of this invention are to be found in the claims and should not include the following or any other potential objects.

Therefore, it is an object of this invention to provide a PDC with an enhanced residual stress distribution.

It is a further object of this invention to provide a PDC with an interface geometry that has a network of protrusions that are closed in form and that defines cavities and that share common walls that favorably manipulates the residual stresses.

It is a further object of this invention to provide a PDC that increases the strength and working life of a thick diamond table despite the corresponding increase in external diamond tensile stresses.

It is a further object of this invention to provide a PDC that has increased resistance to delamination by providing a mechanical locking device that includes an interface of non-planar networked closed features.

It is a further object of this invention to provide a PDC that has increased diamond attachment strength provided by an interface that has in increased surface area for bonding.

It is a further object of this invention to provide a PDC that exposes multiple diamond surfaces and new cutting edges, as wear progresses, to maintain a sharp cutting action.

It is a further object of this invention to provide a PDC with increased toughness by varying the height of the features across the interface to maintain constant or optimum substrate to diamond volumes.

Additional objects, advantages and other novel features of this invention will be set forth in part in the description that follows and in part will be come apparent to those skilled in the art upon examination of the following description or may be learned with the practice of the invention. Still other objects of the present invention will be come readily apparent to those skilled in the art from the following description wherein there is shown and described several preferred embodiments of this invention, simply by way of illustration of several of the various modes of the invention. As it will be realized, this invention is capable of other different embodiments and its several details and specific features are capable of modification in various aspects without departing from the invention. Accordingly, the objects, drawings and descriptions should be regarded as illustrative in nature and not as restrictive.

BRIEF DESCRIPTION OF DRAWINGS

The accompanying drawings, incorporated in and forming a part of the specification, illustrate present preferred embodiments of the present invention. Some, although not all, alternative embodiments are described in the following description. In the drawings.

Reference will now be made in detail to the present preferred embodiments of the invention, examples of which are illustrated in the accompanying drawings.

DETAILED DESCRIPTION

This invention is intended primarily for use as the cutting structure on earth boring devices used in oil and gas exploration, drilling, mining, excavating and the like. The mechanical and thermal properties of polycrystalline diamond make it an ideal material for cutting tools. However, like most hard materials, diamond is brittle and relatively weak under tensile loading. This is why it is so beneficial to make PDC designs that can manage the residual stresses associated with the large thermal expansion mismatch between the diamond layer and the substrate. Designs that minimize tensile stresses and maximize the compressive stresses in diamond are particularly desirable. The presence or absence of either of these residual stresses is a major determinant for significantly improving or weakening the working strength of the PDC. This invention by providing the benefits of increased attachment strength and a plurality of cutting edges is advantageous because it manipulates the residual stresses to a favorable condition to appreciably increase the working life of the cutter.

Figure 1:
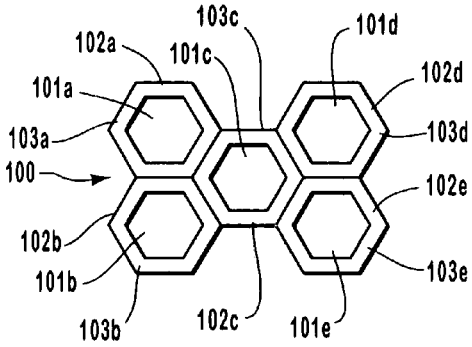
FIG. 1 depicts a first present interface pattern of a closed network of features, which are hexagonal protrusions with common walls that encompass a hexagonal cavity that resembles a honeycomb.

FIG. 1 shows the present preferred interface pattern 100 of the closed network of features, which in this embodiment are hexagonal protrusions 103*a–e* with common walls 102*a–e* that encompass hexagonal cavities 101*a–e* that together resembles a honeycomb. The cavities 101*a–e* are provided to receive the diamond table to provide a transition from the substrate to the diamond table to soften the stress gradient across the interface. It has been determined that along with residual stresses, the diamond-carbide interface attachment strength is directly related to the dynamic toughness of the PDC. The network of closed features provided by the interface pattern 100 increases the attachment strength of the diamond and thereby increases the toughness of the PDC. These closed features form cavities 101*a–e* to act as mechanical locks to increase the attachment strength of the diamond table to the substrate. Due to the difference in thermal expansion between the substrate and the diamond layer, the substrate will typically contract more than the diamond layer. This causes the closed network of features of the interface pattern 100 to clamp down or pinch the enclosed diamond forming a mechanical lock that increases the attachment strength between the diamond layer and the substrate. This network of closed features of the interface pattern 100 also provides a substantial increase in surface area compared to more traditional planar interface designs. With increased surface area more chemical bonds are formed between the substrate and the diamond layer also increasing the attachment strength.

The thickness of walls 102*a–e* of the protrusions can vary depending on the desired stress state. In some embodiments, the wall 102*a–e* thickness can be uniform throughout the pattern 100, or can vary across the pattern 100 depending on the desired stresses. The wall 102*a–e* thickness of the present embodiment is between 0.015" and 0.030" and is uniform throughout the network 100.

Figure 2:
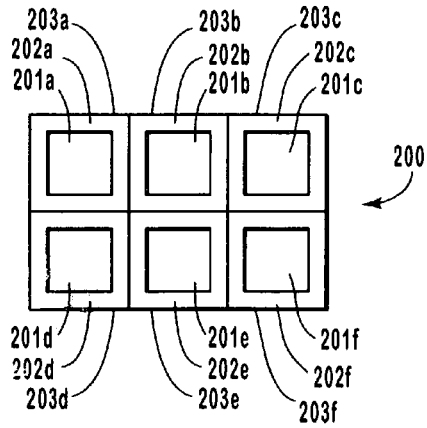
FIGS. 2, 3 and 4 depict alternative interface patterns that include various geometric shaped protrusions with common walls defining cavities within.
Figure 3:
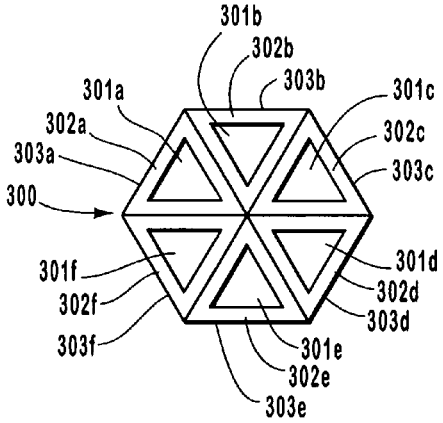
Figure 4:
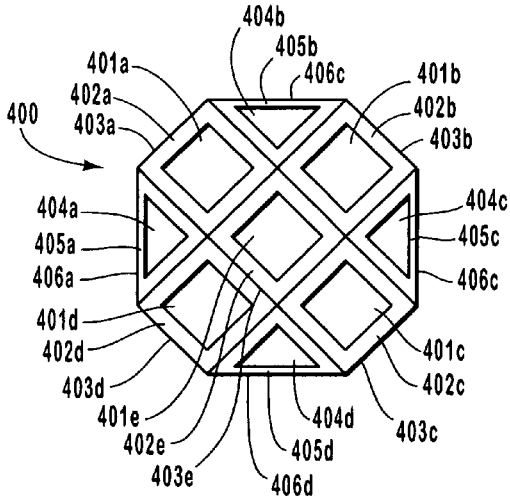

FIGS. 2, 3 and 4 show a variety of alternative protrusion shapes that can be used in alternative networks of closed features 200, 300, 400.

FIG. 2 shows a first alternative interface pattern 200 that includes a series of square protrusions 203*a–f* with common walls 202*a–f* defining square cavities 201*a–f* within.

FIG. 3 shows a second alternative interface pattern 300 that includes triangular protrusions 303*a–f* with common walls 302*a–f* defining triangular cavities 301*a–f* within.

FIG. 4 shows a third alternative interface pattern 400 that includes both diamond shaped protrusions 403*a–e* and triangular protrusions 406*a–d* that share common walls 402*a–e*, 405*a–d* and that define diamond shaped cavities 401*a–e* and triangular cavities 404*a–d* within.

Each of these FIGS. 1–4 are provided to show examples of different geometries. Naturally, a wide variety different geometries are envisioned and can be substituted without departing from the concept of this invention. Such other geometries include, but are not necessarily limited to other polygon shapes, circles, conics, ovals, abstract shapes or combinations thereof.

Figure 5:
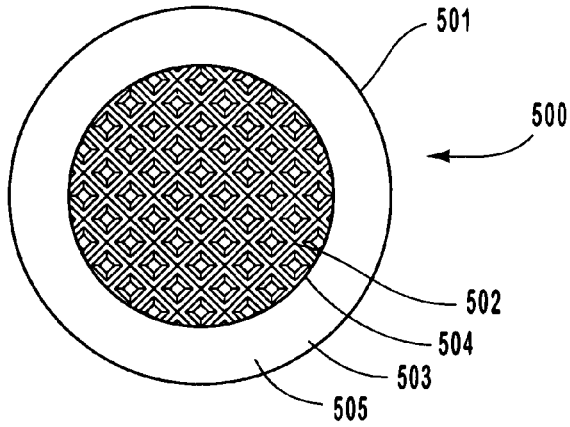
FIG. 5 depicts a top view of a substrate with a network of closed square features. The interface design of this embodiment also includes a peripheral recessed ring.

FIG. 5 shows a top view 500 of a substrate 501 with a network of closed square features 502. The interface design 503 includes a circular portion 504 and peripheral ring 505 that can be varied in width and depth depending on desired stress conditions. The network of closed features 502 can include more than a circular portion 504 and may include polygons, conics, ovals, abstract shapes and combinations thereof.

Figure 6:
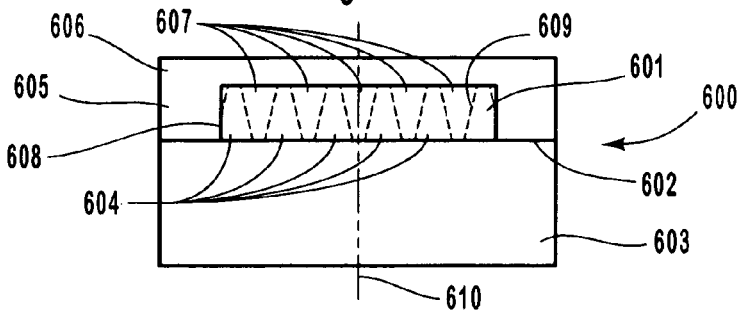
FIGS. 6, 7, 8, 9, 10 and 11 depict alternative cross-sectional views of various PDC designs with closed network features that either protrude from or recess into the face of the substrate.

FIG. 6 shows a cross-sectional view 600 of a PDC with a constant depth closed network design 601 that protrudes from the face 602 of the substrate 603. Protrusions 604 define a peripheral ring 605 of thick diamond 606. The diamond 606 fills the cavities 607 to provide a transition between the diamond 606 and the substrate 603 to soften the stress gradient across the interface 608 and to increase the attachment strength between the diamond 606 and the substrate 603. The closed features of the network design 601 are represented to include a draft angled wall 609 for manufacturing ease but are not limited to obtuse angled walls 609 and can include vertical and acute angled walls relative to the substrate center axis 610. The polycrystalline diamond 606 region is bonded to the substrate 603 typically through a high temperature/high pressure sintering process, although in alternative embodiments bonding can be accomplished by brazing or by chemical vapor deposition or the like. Also, alternatively cubic boron nitride (CBN) or other superabrasive materials can be substituted for the polycrystalline diamond 606 without departing from the concept of this invention. The preferred substrate 603 material is made of tungsten carbide, although in alternative embodiments, such materials as titanium carbide, tantalum carbide, vanadium carbide, niobium carbide, hafnium carbide, zirconium carbide, or alloys thereof can be used in the substrate 603.

Figure 7:
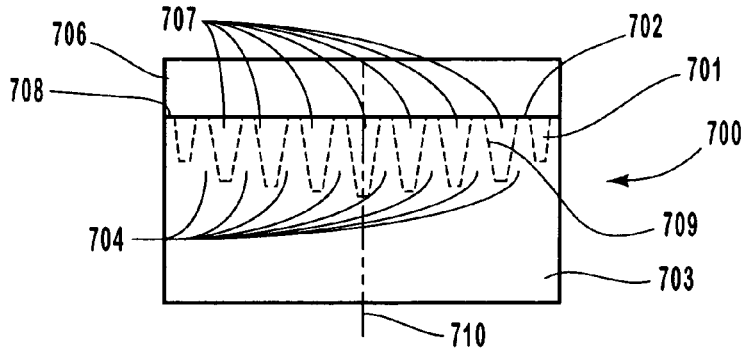

FIG. 7 shows a cross-sectional view 700 of a first alternative PDC design with a variable depth closed network design 701 that protrudes from the face 702 of the substrate 703. Protrusions 704 extend generally across the face 702 of the substrate 703. The diamond 706 fills the cavities 707 to provide a transition between the diamond 706 and the substrate 703 to soften the stress gradient across the interface 708 and to increase the attachment strength between the diamond 706 and the substrate 703. The closed features of the network design 701 are represented to include a draft angled wall 709 for manufacturing ease but are not limited to obtuse angled walls 709 and can include vertical and acute angled walls relative to the substrate center axis 710. The polycrystalline diamond 706 region is bonded to the substrate 703 typically through a high temperature/high pressure sintering process, although in alternative embodiments bonding can be accomplished by brazing or by chemical vapor deposition or the like. Also, alternatively cubic boron nitride (CBN) or other superabrasive materials can be substituted for the polycrystalline diamond 706 without departing from the concept of this invention. The preferred substrate 703 material is made of tungsten carbide, although in alternative embodiments, such materials as titanium carbide, tantalum carbide, vanadium carbide, niobium carbide, hafnium carbide, zirconium carbide, or alloys thereof can be used in the substrate 703.

Figure 8:
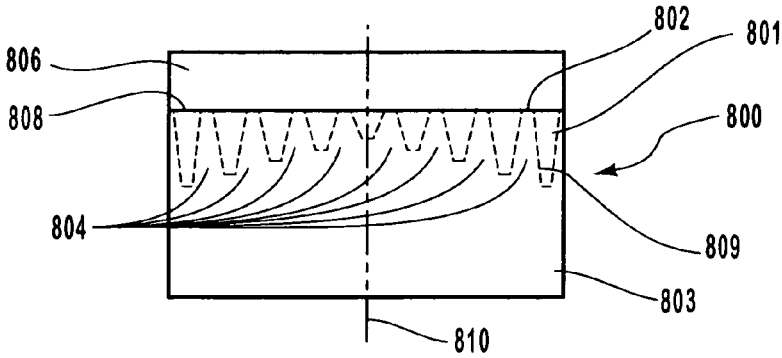

FIG. 8 shows a cross-sectional view 800 of a second alternative PDC design with an alternative variable depth closed network design 801 that recesses into the face 802 of the substrate 803. The recesses 804 extend generally across the face 802 of the substrate 803 and in this embodiment the depth of the recesses 804 decrease at they 804 approach the center axis 810 of the substrate 803. The diamond 806 fills the recesses 804 to provide a transition between the diamond 806 and the substrate 803 to soften the stress gradient across the interface 808 and to increase the attachment strength between the diamond 806 and the substrate 803. Although in this shown embodiment 800, the recess 804 bottom geometry is depicted as constant throughout the network 801 while the recess 804 opening size increases with depth, in alternative embodiments straight walled recesses 804 can be substituted so that both the recess 804 bottom and opening can remain constant. The closed features of the network design 801 are represented to include a draft angled wall 809 for manufacturing ease but are not limited to obtuse angled walls 809 and can include vertical and acute angled walls relative to the substrate center axis 810. The polycrystalline diamond 806 region is bonded to the substrate 803 typically through a high temperature/high pressure sintering process, although in alternative embodiments bonding can be accomplished by brazing or by chemical vapor deposition or the like. Also, alternatively cubic boron nitride (CBN) or other superabrasive materials can be substituted for the polycrystalline diamond 806 without departing from the concept of this invention. The preferred substrate 803 material is made of tungsten carbide, although in alternative embodiments, such materials as titanium carbide, tantalum carbide, vanadium carbide, niobium carbide, hafnium carbide, zirconium carbide, or alloys thereof can be used in the substrate 803.

Figure 9:
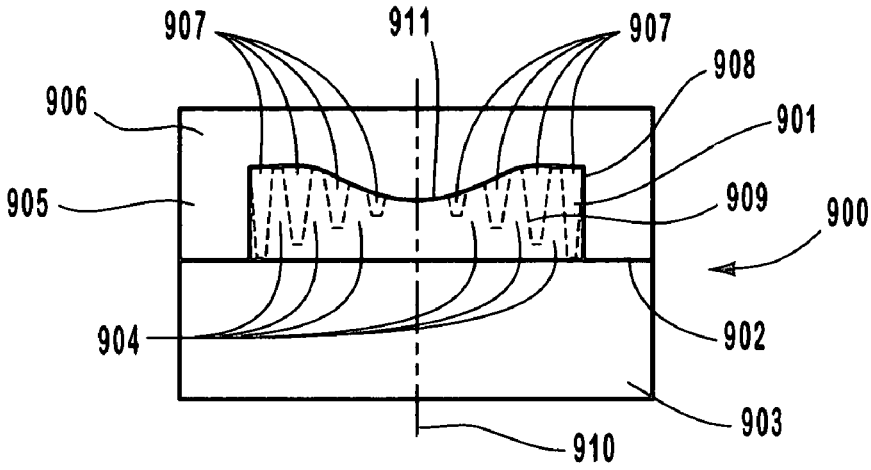

FIG. 9 shows a cross-sectional view 900 of a third alternative PDC with an alternative variable depth closed network design 901 that protrudes from the face 902 of the substrate 903. Protrusions 904 define a peripheral ring 905 of thick diamond 906. The diamond 906 fills the cavities 907 to provide a transition between the diamond 906 and the substrate 903 to soften the stress gradient across the interface 908 and to increase the attachment strength between the diamond 906 and the substrate 903. The closed features of the network design 901 are represented to have a top surface 911 that is generally concave and the protrusions include a draft angled walls 909 for manufacturing ease but are not limited to obtuse angled walls 909 and can include vertical and acute angled walls relative to the substrate center axis 910. Alternatively, it is envisioned that the top surface 911 can be flat, convex or combinations thereof. The polycrystalline diamond 906 region is bonded to the substrate 903 typically through a high temperature/high pressure sintering process, although in alternative embodiments bonding can be accomplished by brazing or by chemical vapor deposition or the like. Also, alternatively cubic boron nitride (CBN) or other superabrasive materials can be substituted for the polycrystalline diamond 906 without departing from the concept of this invention. The preferred substrate 903 material is made of tungsten carbide, although in alternative embodiments, such materials as titanium carbide, tantalum carbide, vanadium carbide, niobium carbide, hafnium carbide, zirconium carbide, or alloys thereof can be used in the substrate 903.

Figure 10:
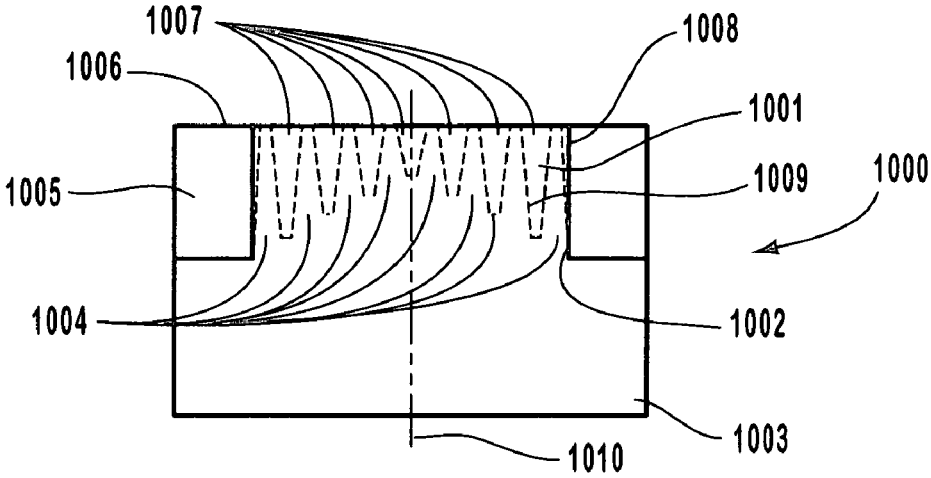

FIG. 10 shows a cross-sectional view 1000 of a fourth alternative PDC with a variable depth closed network design 1001 that recesses 1004 into the face 1002 of the substrate 1003. The recesses 1004 define a peripheral ring 1005 of thick diamond 1006. The diamond 1006 also fills the recesses 1007 to provide a transition between the diamond 1006 and the substrate 1003 to soften the stress gradient across the interface 1008 and to increase the attachment strength between the diamond 1006 and the substrate 1003. The closed features of the network design 1001 are represented to include a draft angled wall 1009 for manufacturing ease but are not limited to obtuse angled walls 1009 and can include vertical and acute angled walls relative to the substrate center axis 1010. The polycrystalline diamond 1006 region is bonded to the substrate 1003 typically through a high temperature/high pressure sintering process, although in alternative embodiments bonding can be accomplished by brazing or by chemical vapor deposition or the like. Also, alternatively cubic boron nitride (CBN) or other superabrasive materials can be substituted for the polycrystalline diamond 1006 without departing from the concept of this invention. The preferred substrate 1003 material is made of tungsten carbide, although in alternative embodiments, such materials as titanium carbide, tantalum carbide, vanadium carbide, niobium carbide, hafnium carbide, zirconium carbide, or alloys thereof can be used in the substrate 1003.

Figure 11:
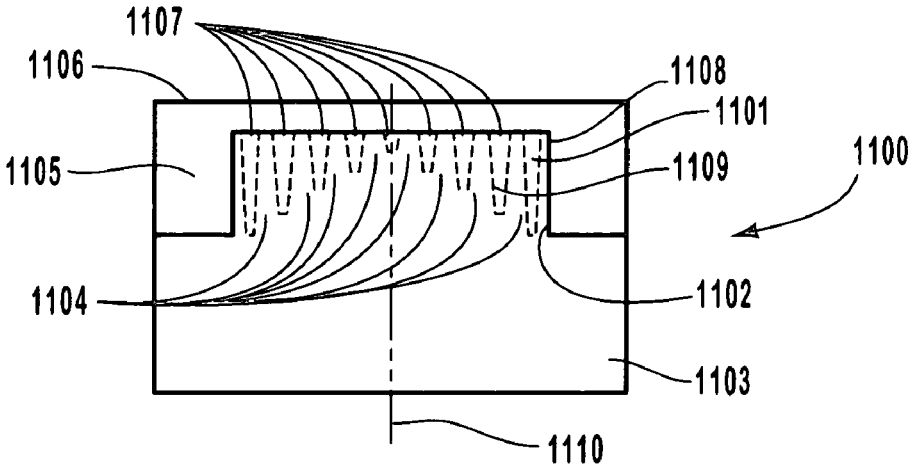

FIG. 11 shows a cross-sectional view 1100 of a fifth alternative PDC with a variable depth closed network design 1101 that protrudes from the face 1102 of the substrate 1103. Protrusions 1104 define a peripheral ring 1105 of thick diamond 1106. The diamond 1106 fills the cavities 1107 to provide a transition between the diamond 1106 and the substrate 1103 to soften the stress gradient across the interface 1108 and to increase the attachment strength between the diamond 1106 and the substrate 1103. The closed features of the network design 1101 are represented to include a draft angled wall 1109 for manufacturing ease but are not limited to obtuse angled walls 1109 and can include vertical and acute angled walls relative to the substrate center axis 1110. The polycrystalline diamond 1106 region is bonded to the substrate 1103 typically through a high temperature/high pressure sintering process, although in alternative embodiments bonding can be accomplished by brazing or by chemical vapor deposition or the like. Also, alternatively cubic boron nitride (CBN) or other superabrasive materials can be substituted for the polycrystalline diamond 1106 without departing from the concept of this invention. The preferred substrate 1103 material is made of tungsten carbide, although in alternative embodiments, such materials as titanium carbide, tantalum carbide, vanadium carbide, niobium carbide, hafnium carbide, zirconium carbide, or alloys thereof can be used in the substrate 1103.

Figure 12:
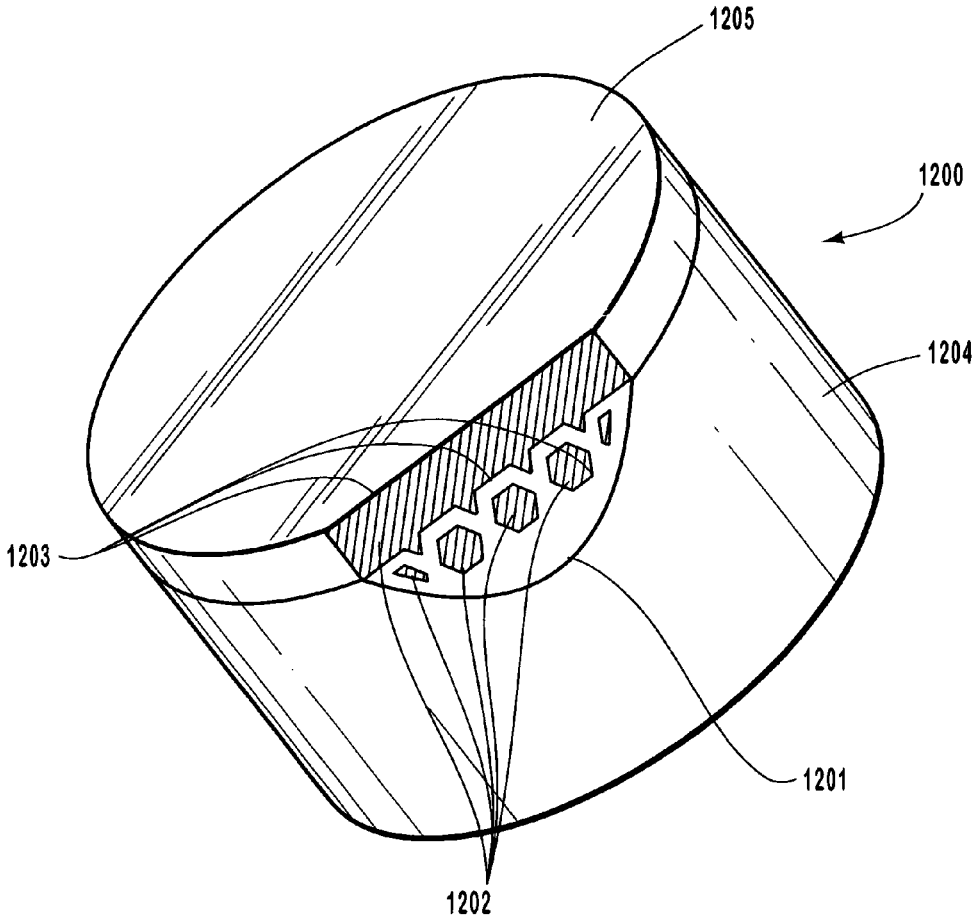
FIG. 12 depicts an embodiment of the invention with a large wear flat that exposes a number of diamond surfaces and cutting edges.

FIG. 12 shows an embodiment of this invention 1200 with a large wear flat 1201 in both the diamond layer 1205 and the substrate 1201 that has exposed a plurality of diamond surfaces 1202 and cutting edges 1203. This FIG. 12 is representative of a typical extended wear flat that can be seen on typical used PDC inserts. Generally, as extended wear flats 1201 are produced the drilling efficiency of a PDC insert drops dramatically. Instead of a sharp edge to bite and shear the formation, an extended wear flat acts as a bearing surface that will not engage the formation to be cut unless increased force is applied to the drilling assembly. Maintaining a sharp cutter or edge is preferred for efficient drilling. With this embodiment of the invention, as wear progresses into the network cavities, new diamond surfaces 1202 and cutting edges 1203 are exposed, further enhancing drilling efficiency.

Figure 13:
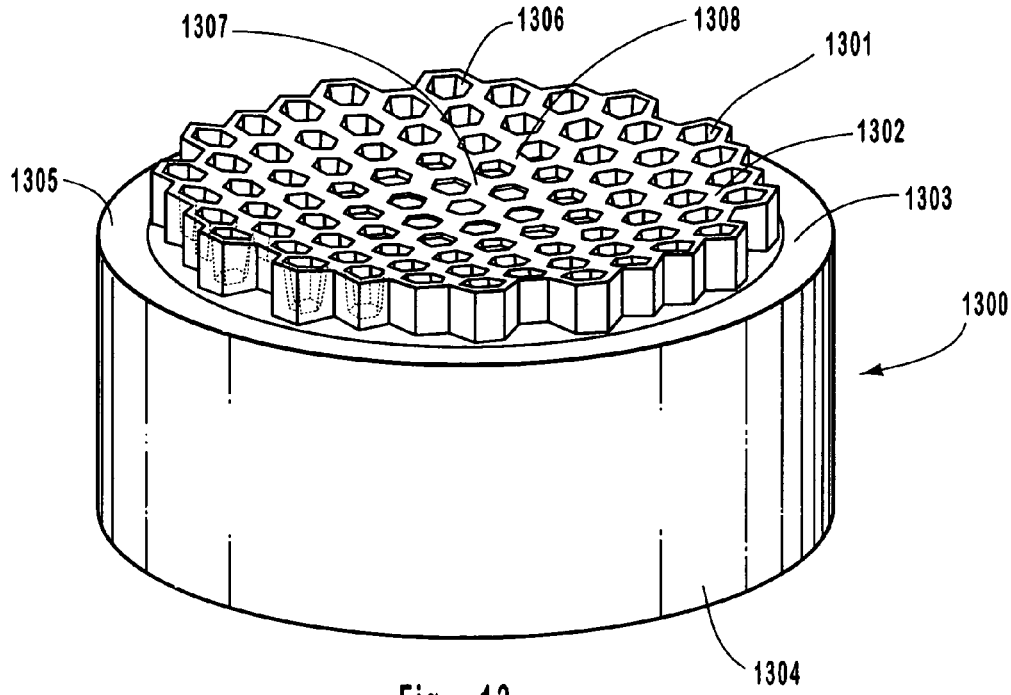
FIGS. 13 and 14 depict alternative embodiments of the substrate interface design. These designs include hexagonal protrusions that extend out from the face of the substrate and define a peripheral ring. Internal cavity depths decrease as they approach the center of the substrate. The protrusions define a surface that can be flat, concave or convex.
Figure 14:
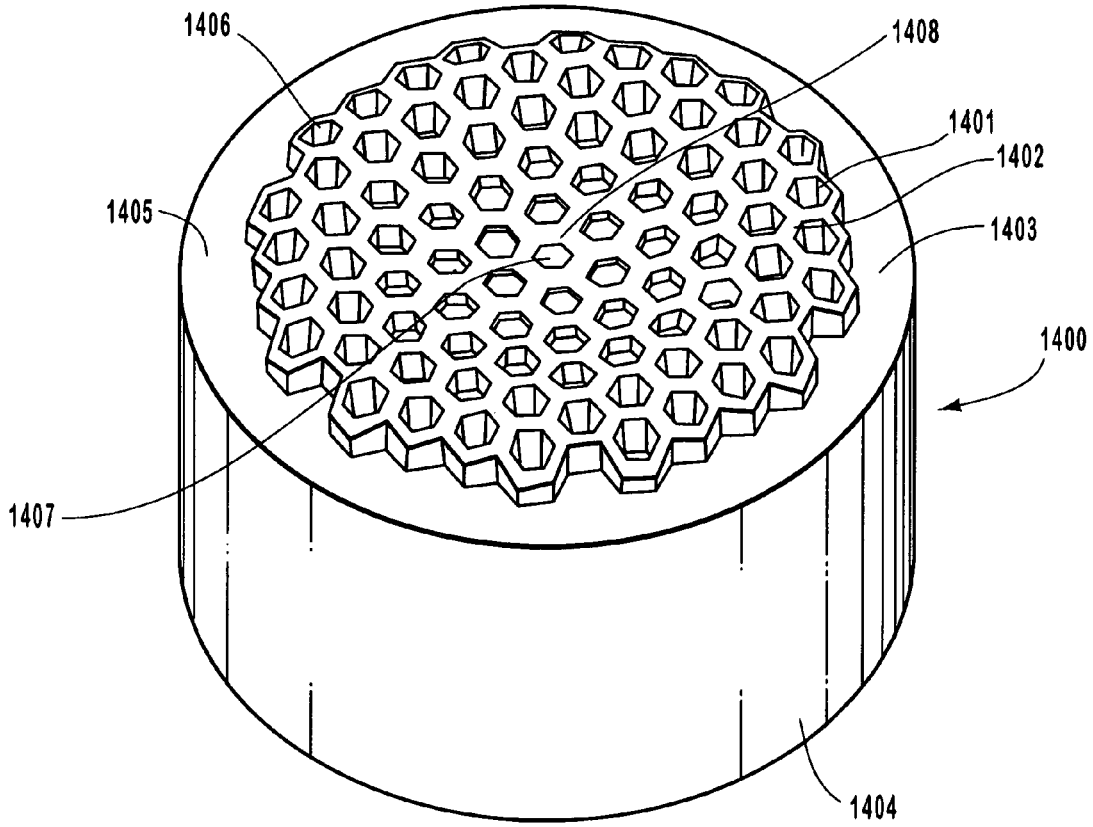

FIGS. 13 and 14 depict alternative embodiments 1300, 1400 of the substrate interface design 1301, 1401. As can be seen, these design 1301, 1401 also have hexagonal protrusions 1302, 1402 that extend out from the face 1303, 1403 of the substrate 1304, 1404 and define a peripheral ring 1305, 1405. The internal cavity 1306, 1406 depths decrease as they approach the center 1307, 1407 of the substrate 1304, 1404. The protrusions 1302 in FIG. 13 provide a generally concave interface surface 1308, while the protrusions 1402 in FIG. 14 provide a generally convex interface surface 1408. In alternative embodiments, the interface surface could be flat or a combination of flat, concave and convex.

Figure 15A:
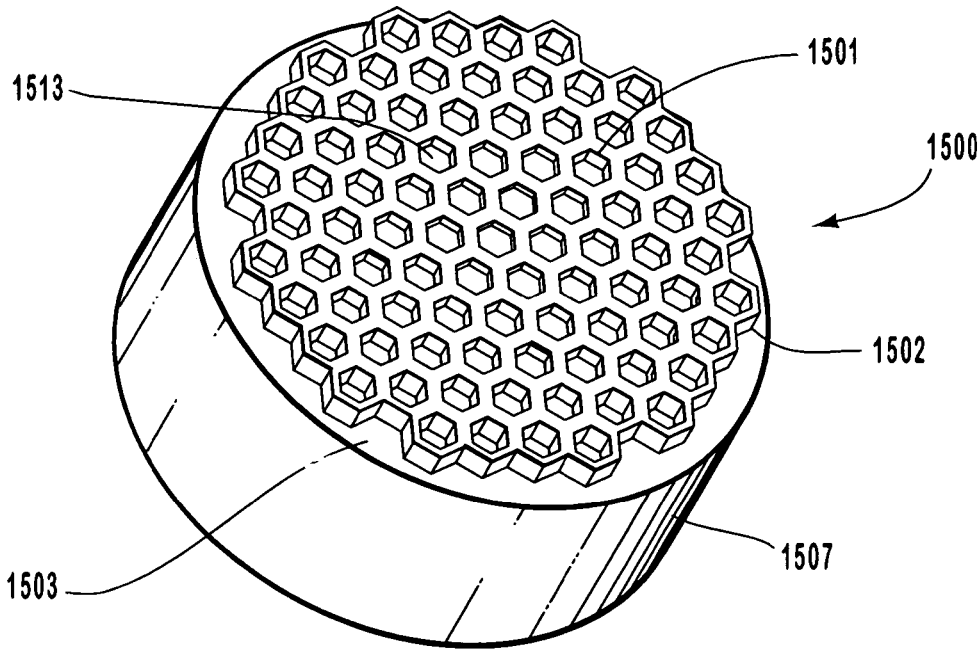
FIG. 15 depicts a present embodiment of the substrate interface design. This design includes hexagonal protrusions that extend out from the face of the substrate and define a peripheral ring. The internal depths decrease as they approach the center of the substrate. The protrusions of this embodiment define a surface that is flat.
Figure 15B:
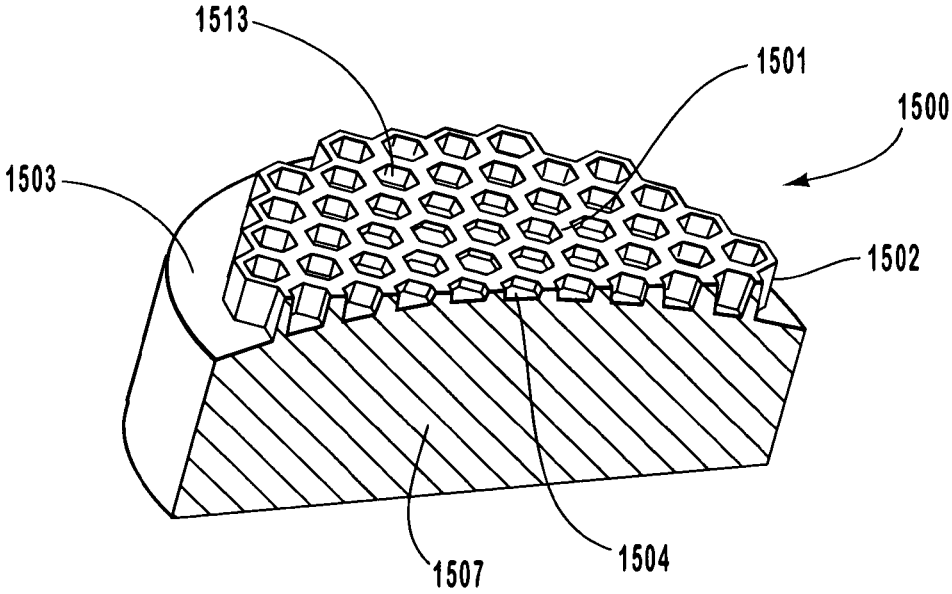
Figure 15C:
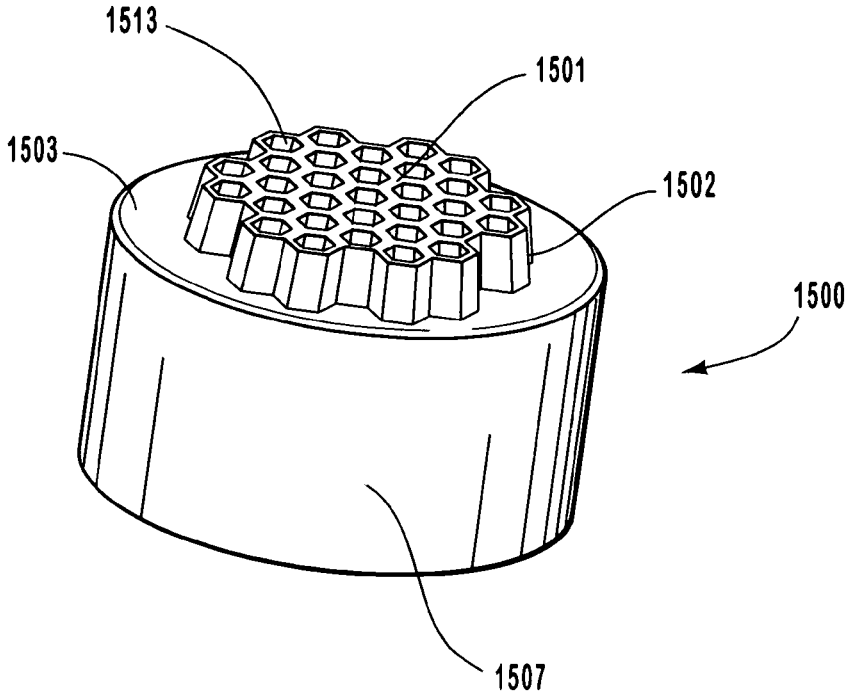
Figure 15D:
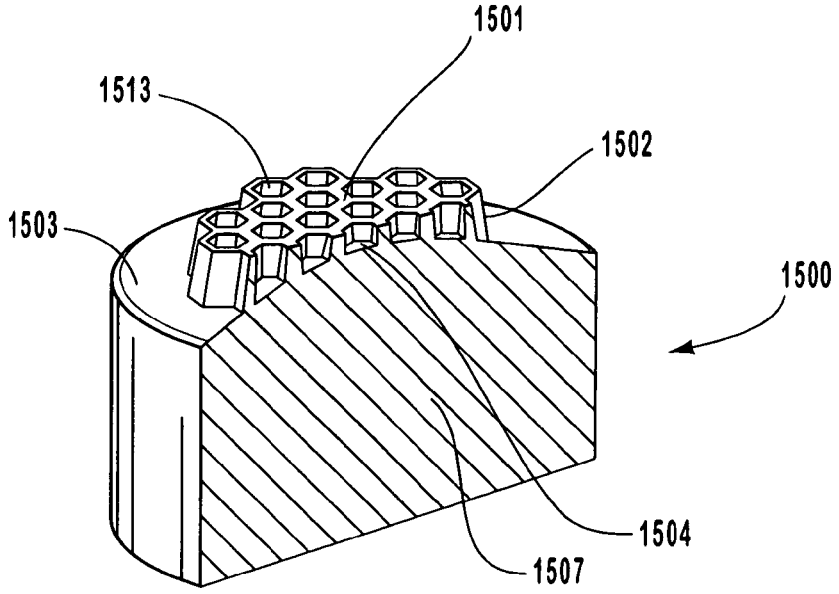
Figure 15E:
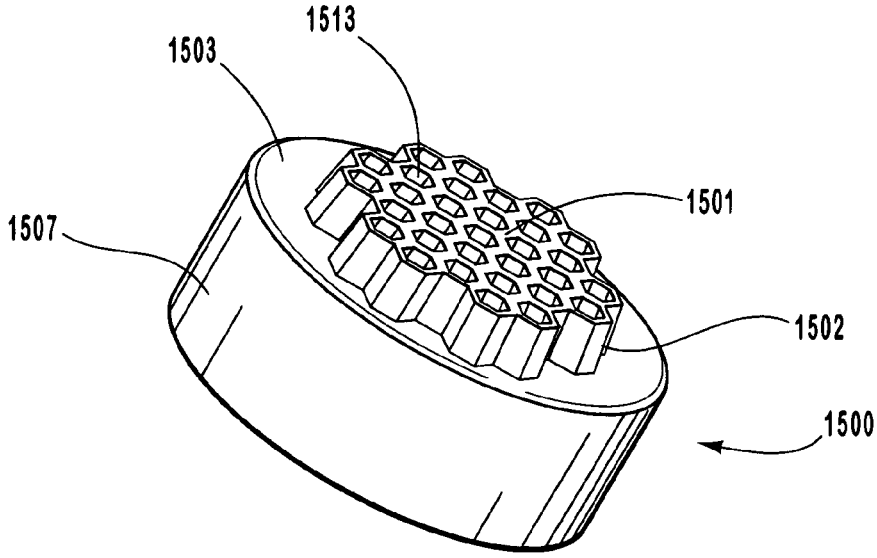
Figure 15F:
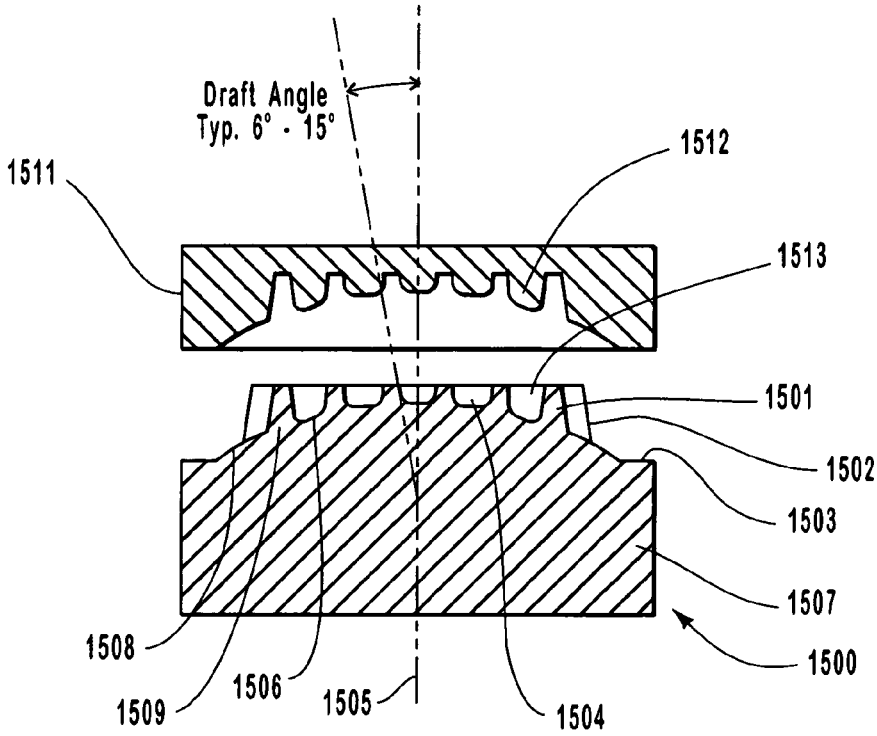

FIGS. 15*a, b, c, d, e* and *f* show several views of the present substrate interface design of this invention. Hexagonal protrusions 1501 extend out from the face 1502 of the substrate 1507 and define a peripheral ring 1503. The protrusions 1501 define a surface 1513 that is flat. The internal cavity 1504 depths decrease as they approach the center 1505 of the substrate 1507. The cavity's 1504 bottom hole shape 1506 follows the profile 1509 of a dome that protrudes from the surface 1508 of the substrate 1507. This domed profile 1509 allows the diamond volume to gradually increase as it moves toward the perimeter 1510 of the PDC 1500. The closed features of the hexagonal protrusions 1501 include a draft angle 1511 for conventional powdered metallurgy pressing techniques. Polycrystalline diamond 1512 is bonded to the substrate 1507 typically through a high temperature/high pressure sintering process. Polycrystalline diamond, although the preferred material for the superhard surface, may alternatively be substituted with cubic boron nitride (CBN) or any other appropriate superhard material. The preferred substrate 1507 is composed of tungsten carbide, although alterative materials such as titanium carbide, tantalum carbide, vanadium carbide, niobium carbide, hafnium carbide, zirconium carbide, or alloys thereof can be substituted without departing from the concept of this invention.

The described preferred and alternative embodiments of this disclosure are to be considered in all respects only as illustrative of the current best modes of the invention known to the inventors and not as restrictive. Alternative embodiments of the invention, including a combination of one or more of the features of the foregoing PDC devices should be considered within the scope of this invention. The appended claims define the scope of this invention. All processes and devices that come within the meaning and range of equivalency of the claims are to be considered as being within the scope of this patent.

The invention claimed is:

1. A superhard compact, comprising:

a substrate having a top surface and wherein said top surface further comprises more than one cavity in said substrate defined by closed walled features to form a network of closed walled features forming an interface region, said closed walled features being composed of the same material as said substrate; and a superhard layer bonded directly to said substrate over said interface region, wherein said superhard layer comprises a superhard material and extends into each of the more than one cavity of said substrate.

2. A superhard compact, as recited in claim 1, wherein said closed walled features protrude out from said top surface of said substrate.

3. A superhard compact, as recited in claim 1, wherein said closed walled features are recessed into said substrate from said top surface of said substrate.

4. A superhard compact, as recited in claim 1, wherein said closed walled features form a network of polygons.

5. A superhard compact, as recited in claim 1, wherein said closed walled features have a thickness that varies.

6. A superhard compact, as recited in claim 1, wherein said closed walled features form a network of abstract shapes.

7. A superhard compact, as recited in claim 1, wherein said top surface is domed.

8. A superhard compact, as recited in claim 1, wherein said substrate further comprises a material selected from the group consisting of: tungsten carbide, titanium carbide, tantalum carbide, vanadium carbide, niobium carbide, hafnium carbide, and zirconium carbide.

9. A superhard compact, as recited in claim 1, wherein said superhard material comprises polycrystalline diamond or cubic boron nitride.

10. A superhard compact as recited in claim 1, wherein at least one respective depth of one of the more than one cavity is different from another respective depth of another of the more than one cavity.

11. A superhard compact, comprising:

a substrate having a top surface having a domed profile, wherein said domed profile further comprises more than one cavity defined by closed walled features that form a network of closed walled features forming an interface region, said closed walled features being composed of the same material as said substrate; and a superhard layer bonded directly to said substrate over said interface region.

12. A superhard compact, as recited in claim 11, wherein said closed walled features protrude out from said domed profile on said top surface.

13. A superhard compact, as recited in claim 11, wherein said closed walled features are recessed into said substrate from said domed on said top surface.

14. A superhard compact, as recited in claim 11, wherein said closed walled features form a network of polygons.

15. A superhard compact, as recited in claim 11, wherein said closed walled features have a thickness that varies.

16. A superhard compact, as recited in claim 11, wherein said closed walled features form a network of abstract shapes.

17. A superhard compact, as recited in claim 11, wherein said closed walled features extend through said superhard surface.

18. A superhard compact: as recited in claim 11, wherein said substrate further comprises a material selected from the group consisting of: tungsten carbide, titanium carbide, tantalum carbide, vanadium carbide, niobium carbide, hafnium carbide and zirconium carbide.

19. A superhard compact, as recited in claim 11, wherein said superhard material comprises diamond or cubic boron nitride.

20. A superhard compact as recited in claim 11, wherein at least one respective depth of one of the more than one cavity is different from another respective depth of another of the more than one cavity.

21. A superhard compact, comprising:

a substrate having a top surface and including more than one cavity defining a network of closed walled features forming an interface region;

wherein the closed walled features form a honeycomb structure;

a superhard layer bonded directly to said substrate over said interface region.

* * * * *